US008104738B2

(12) United States Patent
Schwörer

(10) Patent No.: US 8,104,738 B2
(45) Date of Patent: Jan. 31, 2012

(54) CONCRETE SHELL SYSTEM INCLUDING CLAMPING DEVICES HAVING DIAGONALLY GUIDED WEDGES

(75) Inventor: Artur Schwörer, Senden (DE)

(73) Assignee: Peri GmbH, Weissenhorn (DE)

( * ) Notice: Subject to any disclaimer, the term of this patent is extended or adjusted under 35 U.S.C. 154(b) by 383 days.

(21) Appl. No.: 10/563,405

(22) PCT Filed: Jul. 2, 2004

(86) PCT No.: PCT/DE2004/001410

§ 371 (c)(1),
(2), (4) Date: Jan. 4, 2006

(87) PCT Pub. No.: WO2005/007997

PCT Pub. Date: Jan. 27, 2005

(65) Prior Publication Data

US 2006/0182494 A1 Aug. 17, 2006

(30) Foreign Application Priority Data

Jul. 11, 2003 (DE) ..... 103 31 359

(51) Int. Cl.
*E04G 11/08* (2006.01)
*E04G 17/00* (2006.01)

(52) U.S. Cl. ..... 249/194; 249/47; 249/219.1

(58) Field of Classification Search ..... 249/44, 249/47, 191, 192, 219.1, 194
See application file for complete search history.

(56) References Cited

U.S. PATENT DOCUMENTS

| | | | | | |
|---|---|---|---|---|---|
| 1,552,334 | A | * | 9/1925 | Mosher | 249/219.1 |
| 2,868,250 | A | | 1/1959 | Holmboe, Sr. | |
| 3,011,228 | A | * | 12/1961 | Driggs | 52/282.4 |
| 3,595,514 | A | * | 7/1971 | Sanders | 249/47 |
| 4,280,677 | A | * | 7/1981 | Shahar | 249/192 |
| 5,078,360 | A | * | 1/1992 | Spera | 249/192 |
| 5,570,500 | A | | 11/1996 | Merkel | |

FOREIGN PATENT DOCUMENTS

| | | | | | |
|---|---|---|---|---|---|
| CH | 685453 | A5 | | 7/1995 | |
| DE | 27 16 864 | | | 10/1978 | |
| DE | 3517304 | | * | 11/1986 | 249/219.1 |
| DE | 3545273 | A1 | | 6/1987 | |
| DE | 4007950 | | * | 9/1991 | 249/219.1 |
| EP | 0537403 | A1 | | 4/1993 | |
| EP | 0 552 621 | A1 | | 7/1993 | |
| EP | 0580537 | | * | 1/1994 | 249/219.1 |
| ES | 2084137 | | * | 5/1996 | 249/219.1 |
| ES | 2239916 | | * | 10/2005 | 249/219.1 |
| FR | 2 783 859 | | * | 3/1997 | 249/192 |

* cited by examiner

*Primary Examiner* — Michael Safavi
(74) *Attorney, Agent, or Firm* — Walter A. Hackler

(57) ABSTRACT

A turnbuckle device (12, 13, 14; 20; 35*a*, 35*b*, 35*c*; 44*a*, 44*b*, 44*c*) for clamping concrete shell elements (1, 2), having two claws (15*a*, 15*b*, 15*c*, 16*a*, 16*b*, 16*c*; 21, 22) and a wedge (17*a*, 17*b*, 17*c*; 23; 37*a*, 37*b*, 37*c*; 46*a*, 46*b*, 46*c*), the claws being displaceable toward one another in a clamping direction (34), the wedge being guided in the clamping device along a wedge guiding direction (33), and the scale of the propulsion of the wedge in the turnbuckle device determining the displacement of the claws, is characterized in that the wedge guiding direction and the clamping direction enclose an angle less than 90°. Mutual obstruction of the turnbuckle devices neighboring wedges is thus avoided.

7 Claims, 4 Drawing Sheets

CONCRETE SHELL SYSTEM INCLUDING CLAMPING DEVICES HAVING DIAGONALLY GUIDED WEDGES

Figure 1B:
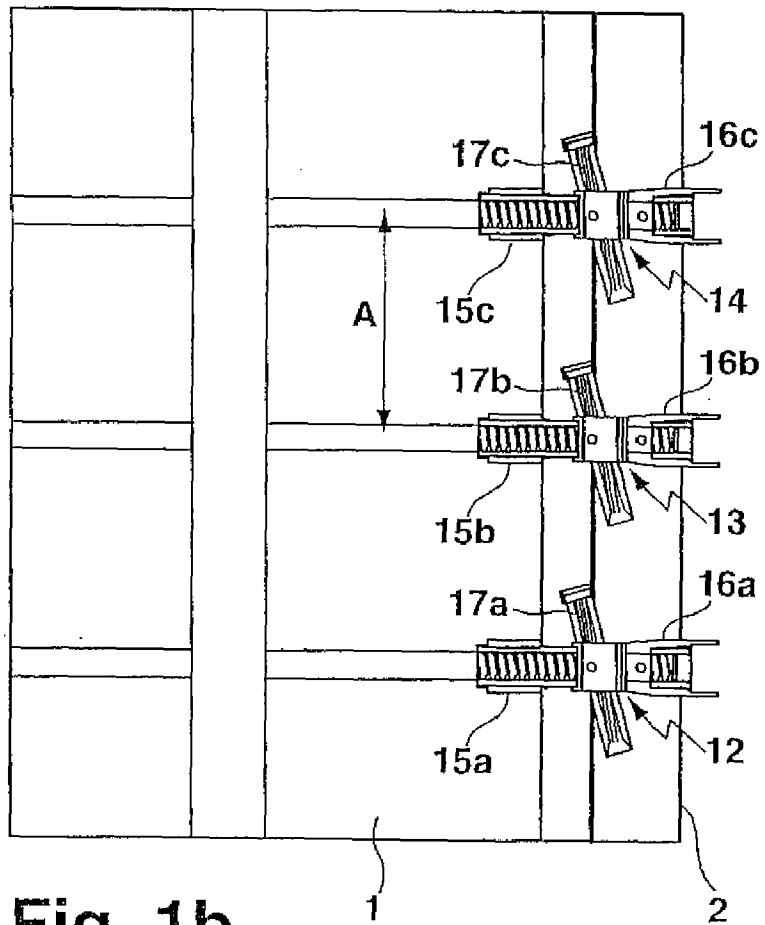

The present invention relates to a turnbuckle device for clamping concrete shell elements, having two claws and a wedge, the claws being displaceable in a clamping direction toward one another, the wedge being guided in the turnbuckle device along a guiding direction, and the dimension of the propulsion of the wedge in the turnbuckle device determining the displacement of the claws.

A turnbuckle device according to the species is known, for example, from DE 35 45 273 A1.

Concrete shell elements are used to erect delimitations for concrete bodies to be cast, such as building walls. In order to obtain delimitations which may be cemented in, multiple concrete shell elements must typically be connected solidly to one another. Turnbuckles are used to connect the concrete shell elements.

The concrete shell elements essentially comprise a shell skin, a frame, and struts for stabilizing the frame. The turnbuckles are typically positioned in the area of the intersections of struts and frames. Each claw of a turnbuckle encloses a frame section of two concrete shell elements to be connected, and the two claws—and therefore the concrete shell elements—are clamped to one another using a wedge, i.e., the claws are moved toward one another and into one another in a clamping direction.

In the turnbuckle devices of the known related art, the direction of the translation of the wedge as it is driven into the turnbuckle device during the clamping (=wedge guiding direction) and the clamping direction have a right angle to one another. If two horizontally neighboring concrete shell elements are connected, i.e., horizontally clamped, using such a turnbuckle device, gravity acts in its entirety on the wedge in such a way that it is drawn in the direction of stronger clamping.

In order to clamp boundary surfaces of two neighboring concrete shell elements which experience especially large forces (such as joint corners or external corners), multiple neighboring turnbuckle devices are used simultaneously. The turnbuckle devices are then typically positioned on a straight line (e.g., one below another), having parallel clamping movements of the claws and parallel movements of the wedges, which occur on one single straight line, during clamping.

The problem thus arises that the wedges of the individual turnbuckle devices may mutually obstruct one another. The turnbuckle devices must be spaced apart at least one wedge length (i.e., the extension of a wedge in the direction of the wedge guiding device when the wedge is positioned in a turnbuckle device). This limits the number of the turnbuckle devices which may be used for securing a boundary surface of two neighboring concrete shell elements.

In practice, however, an even larger spacing of the turnbuckle devices is maintained, since the wedges require movement space during the construction and disassembly of the turnbuckle devices. With spacing only in the magnitude of the wedge length, a precise construction and disassembly sequence of the turnbuckle devices must be maintained, since only the turnbuckle device located at the edge has sufficient space for moving the wedge. Furthermore, sufficient intervals of the wedge ends to any type of obstruction are also to be maintained, so that the use of tools, particularly hammers, for driving and loosening the wedges is possible.

In contrast to this, the object of the present invention is to provide a turnbuckle device in which obstruction of neighboring turnbuckle devices by their wedges may be avoided even in the event of tight spacing of the turnbuckle devices.

This object is achieved according to the present invention in that the wedge guiding direction and the clamping direction enclose an angle $\alpha$ less than 90°.

During clamping of two concrete shell elements, the participating turnbuckle devices span a typically linear boundary line between the concrete shell elements. The turnbuckle devices are positioned next to one another and/or one over another on a straight line running parallel to this boundary line, the clamping movements of the claws of the turnbuckle devices running parallel to one another. Because the wedge guiding direction does not run perpendicular to the clamping direction according to the present invention, the longitudinal directions of the wedges no longer all lie on a single straight line. The wedges are not advanced, in contrast to the related art, along a single straight line for all wedges, but rather each wedge is advanced on its own straight line. Movement space for the wedges is thus obtained. The spacing of the particular separate straight lines from one another is a function of the angle $\alpha$ and the distance of the turnbuckle devices. According to the present invention, the spacing of the particular separate straight lines is selected in such a way that it at least corresponds to a diameter of the wedge (possibly the maximum diameter of the wedge), so that the wedges may no longer come into contact.

Through the teaching according to the present invention, a larger number of turnbuckle devices may be used for clamping per length of the boundary line of neighboring concrete shell elements. In this way, connections of concrete shell elements may be made more secure and, in particular, the maximum mechanical load which may be carried by concrete shell elements may be increased.

In the related art, the propulsion direction of the wedges to the clamped is to be oriented strictly with the force of gravity, in order to secure the wedges against unintentional loosening, as a result of shocks, for example. However, it is completely sufficient to guide a sufficient vector component of the propulsion direction parallel to gravity. Even at a deviation of 45° of the wedge propulsion direction from the gravity vector, approximately 70% of the weight of the wedge is still available for holding the clamping position, corresponding to the sine of 45°.

An embodiment of the turnbuckle device according to the present invention which is characterized in that the angle $\alpha$ is between 40° and 85°, particularly approximately 70°, is preferred. These angle ranges are especially suitable for wedge dimensions and concrete shell elements dimensions which are currently in use. The securing effect of gravity is also still adequate.

A refinement of this embodiment in which the angle $\alpha$ is approximately 45° is especially preferred. At this angle, the turnbuckle device may be used equally well for connecting both horizontally neighboring concrete shell elements and also vertically neighboring concrete shell elements, i.e., the turnbuckle may be operated equally well in the horizontal or vertical clamping direction. In this case, a position of the turnbuckle device may always be selected in which the wedge is forced into the clamping position by more than 70% of its weight.

Furthermore, an embodiment of the turnbuckle device according to the present invention in which the following relationship applies for the angle $\alpha$:

$$\alpha \leqq 90° - \arctan(B/L),$$

with L: length of the wedge in the wedge guiding direction and B: greatest width of the wedge measured transversely to the wedge guiding direction and in the plane of wedge guiding direction and clamping direction, is preferred. If such turnbuckle devices are positioned at an interval A, measured perpendicularly to the clamping direction and/or parallel to the boundary line of the concrete shell elements, the interval A being greater than or equal to L, mutual obstruction of the wedges, particularly touching of the wedges as the turnbuckle devices are assembled or disassembled, is precluded. A selection of the interval A greater than the wedge length L has been maintained until now in all known concrete shell elements having turnbuckle devices, and the embodiment according to the present invention may be used with all handling advantages in such existing concrete shell elements.

Furthermore, an embodiment in which the wedge is guided solely by one of the claws is preferred. The guiding of the wedge is thus simplified. The angle $\alpha$ may then be set very exactly.

In an advantageous embodiment of the turnbuckle device according to the present invention, the wedge has at least one depression and/or protrusion which runs diagonally to the wedge guiding direction, and at least one of the claws has a profile which engages in the depression and/or protrusion of the wedge. The profile may, for example, be implemented as a row of teeth. Turnbuckle devices profiled in this way may be designed in a broad range of transmission ratios (propulsion in relation to clamping path); in particular, they may also be designed well for angles $\alpha$ less than or equal to 45°.

In another advantageous embodiment, the wedge has a cross-section which tapers along the wedge guiding direction. The wedge thus reduces its width in the propulsion direction. Turnbuckle devices which are based on the effect of the changing external dimensions of the wedge are especially mechanically simple and therefore cost-effective.

A refinement of the embodiment having the profiled turnbuckle device is advantageously designed in such a way that the wedge has a constant size, particularly a constant diameter, along the wedge guiding direction. The wedge thus maintains its width along the propulsion direction. This simplifies the guiding of the wedge in the turnbuckle device significantly, and the angle $\alpha$ may be set especially easily and exactly.

An embodiment in which the turnbuckle device may be positioned for mounting on internal joint corners or external joint corners or perpendicular external corners of concrete shell elements is especially preferred. Especially large forces are to be expected on the concrete shell elements at these positions, so that the clamping means to be used must be especially high-performance. Through the teaching according to the present invention, a large number of turnbuckle devices may be mounted at close intervals to one another, so that even large forces may be managed.

A concrete shell system comprising concrete shell elements and turnbuckle devices according to the present invention of the type described above is also within the scope of the present invention, the concrete shell elements each having multiple mounting positions, particularly struts, for the turnbuckle devices, the mounting positions being spaced apart from one another at an interval A in a direction perpendicular to the clamping direction of the turnbuckle devices to be mounted on the mounting positions, characterized in that the following relationship applies for the angle $\alpha$: $\alpha \leqq 90° - \arcsin(B/A)$, with B: greatest width of the wedge measured transversely to the wedge guiding direction and in the plane of wedge guiding direction and clamping direction. With this geometry, the wedges may be moved independently from one another arbitrarily in or against the wedge guiding direction without the wedges being able to hit one another. The ends of the wedges are additionally well accessible to an assembler. The advantages of the present invention apply especially well if the interval A is less than or approximately equal to the length L of the wedge. In this case, the concrete shell system according to the present invention represents the single possibility for making the wedges and/or the turnbuckle devices usable and applicable in this interval. A combination of the concrete shell system according to the present invention with the embodiment of the clamping devices in which $\alpha \leqq 90° - \arctan(B/L)$ is especially preferred. In this case, the lengths of the wedges also do not overlap next to one another, so that especially simple mounting of the turnbuckle devices is possible because of the free access.

In the embodiments described, the clamping direction and the wedge guiding direction typically run parallel to the planes of the shell skins of the concrete shell elements if the shell skins have a shared plane. A turnbuckle device in which the wedge guiding direction does not run parallel to the plane of the shell skins, but rather encloses an angle $\alpha'>0°$ and preferably $0°<\alpha'<10°$, is also considered to belong to the idea according to the present invention. This may be combined with angles $\alpha=90°$ or even $\alpha<90°$. The angle $\alpha'>0°$ may also prevent collision of wedges of neighboring turnbuckle devices. However, the movement clearance for the wedges is limited by the back of the shell skin, which faces toward the turnbuckle device.

Further advantages of the present invention result from the description and the drawing. The above-mentioned features and the features described in the following may also be used according to the present invention individually or combined in arbitrary combinations. The embodiments shown and described are not to be understood as a complete list, but rather have exemplary character for explaining the present invention.

The present invention is illustrated in the drawing and will be explained in greater detail on the basis of exemplary embodiments.

Figure 1A:
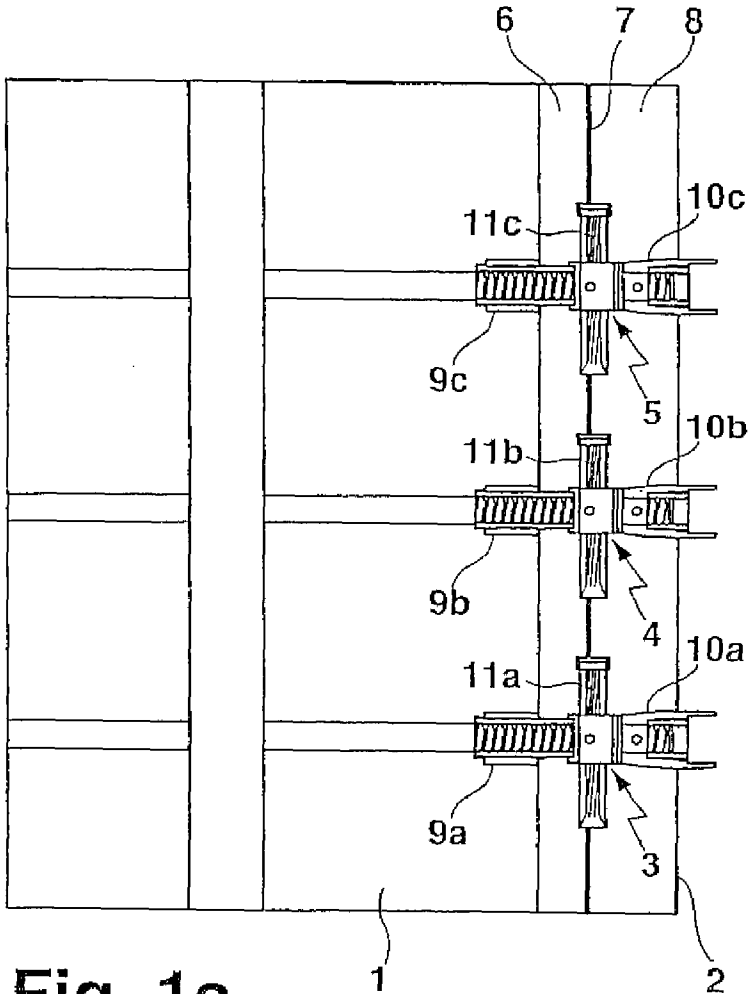
Fig. 1a (Prior Art)
Figure 2:
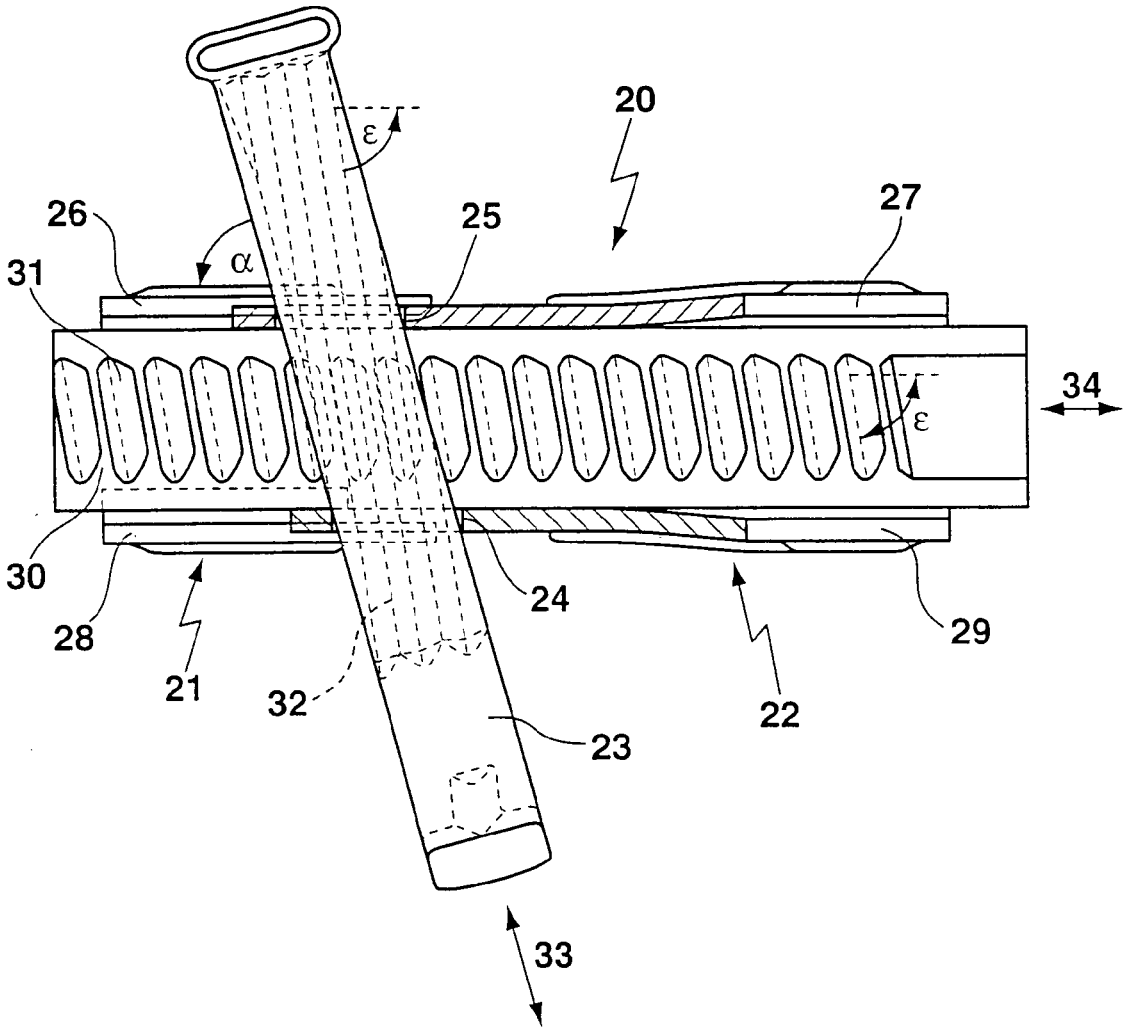
Figure 3A:
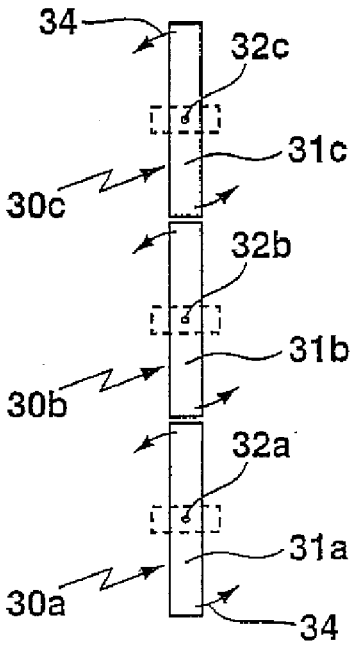
Fig. 3a (Prior Art)
Figure 3B:
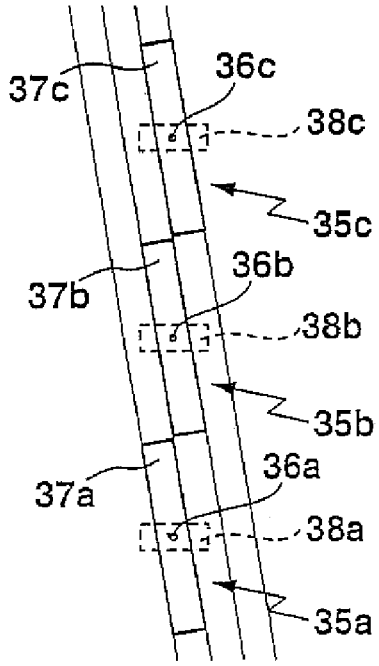
Figure 3C:
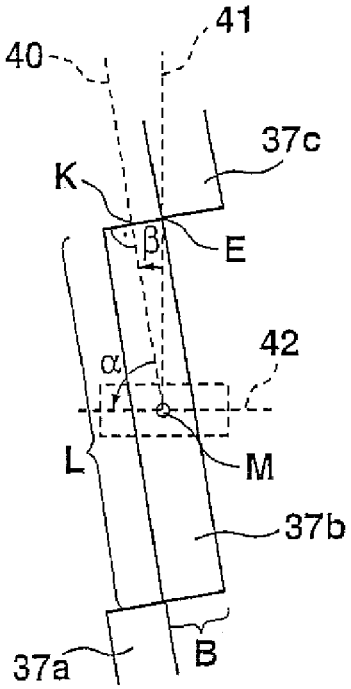

FIG. 1*a*: shows a perpendicular external corner of two concrete shell elements having turnbuckle devices according to the related art;

FIG. 1*b*: shows a perpendicular external corner of two concrete shell elements having turnbuckle devices according to the present invention;

FIG. 2: shows an embodiment of a turnbuckle device according to the present invention having a diagonal wedge;

FIG. 3*a*: shows an arrangement of three wedges of previously known turnbuckle devices on a straight line, the wedges running on the straight line;

FIG. 3*b*: shows an arrangement of pivoted wedges of turnbuckle devices according to the present invention on a connecting straight line, the wedges being pivoted in relation to the connecting straight line;

FIG. 3*c*: shows an enlargement of the middle wedge of FIG. 3*b;*

Figure 3D:
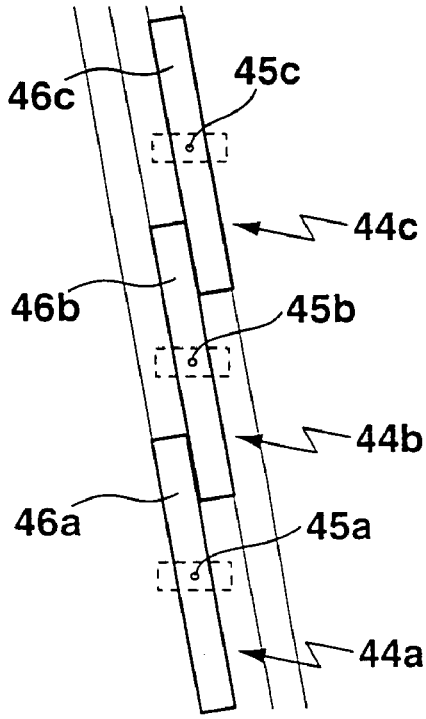
Figure 3E:
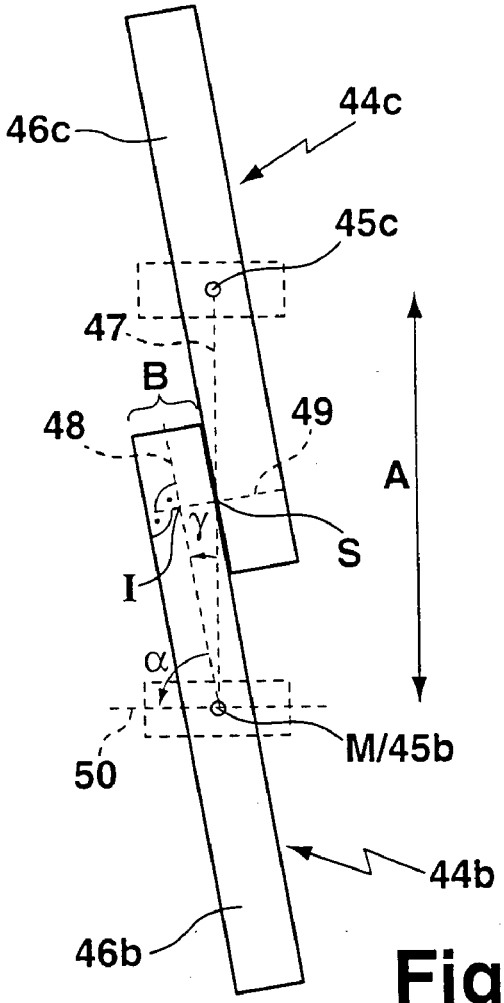

FIG. 3*d*: shows an arrangement of pivoted wedges of turnbuckle devices according to the present invention on a connecting straight line, the wedges being pivoted in relation to the connecting straight line and the lengths of the wedges next to one another overlapping;

FIG. 3*e*: shows an enlargement of two wedges from FIG. 3*d.*

FIG. 1*a* shows the clamping of two concrete shell elements 1, 2, which form a perpendicular external corner, using turnbuckle devices 3, 4, 5 according to the related art.

The first concrete shell element 1 has a vertical shell skin running parallel to the plane of the drawing of FIG. 1*a*. A boundary surface of the first concrete shell element 1 abuts the second concrete shell element 2 at a frame section 6. Only a boundary line 7 of the boundary surface is visible in FIG. 1*a*. The second concrete shell elements 2 has a vertical shell skin running perpendicularly into the plane of the drawing. It abuts the boundary surface, and therefore the boundary line 7, with a frame section 8.

The boundary line 7 is spanned by three turnbuckle devices 3, 4, 5. The turnbuckle devices 3, 4, 5 are positioned on horizontally running struts of the concrete shell elements 1, 2. Each turnbuckle device 3, 4, 5 has a left first claw 9*a*, 9*b*, 9*c*, each of which engages in the frame section 6, and a right second claw 10*a*, 10*b*, 10*c*, which encloses the frame section 8. Using a vertically oriented wedge 11*a*, 11*b*, 11*c*, the claws 9*a*-9*c*, 10*a*-10*c* may be clamped in relation to one another in the horizontal direction (clamping direction). If the wedges 11*a*, 11*b*, 11*c* are driven downward into the associated turnbuckle devices 3, 4, 5, the concrete shell elements 1, 2 are pulled together. In order to loosen the wedges 11*a*, 11*b*, 11*c*, they must be moved upward.

The movement possibilities of the wedges 11*a*, 11*b*, 11*c* are limited in that all wedges 11*a*, 11*b*, 11*c* may only be moved on a single straight line. The middle wedge 11*b* may, for example, only be shifted by approximately a quarter of the wedge length upward or downward without hitting another wedge 11*a* or 11*c*. In particular, the wedge 11*b* may not be pulled out completely in order to loosen the claws 9*b*, 10*b* from one another. The small interval to the neighboring wedges 11*a*, 11*c* in the movement direction of the wedge 11*b*, i.e., in the vertical wedge guiding direction here, additionally obstructs the application of a tool for clamping (advancing) or loosening the wedge 11*b*. In particular, a hammer, which is to drive one of the ends of the wedge 11*b* in or out, may not be raised. Therefore, special tools must be used in the mounting of the construction of FIG. 1*a*, which may handle the wedges 11*a*, 11*b*, 11*c* in spite of the unfavorable attack angle and/or access to the wedge ends. Alternatively, the middle turnbuckle device may also be dispensed with, which reduces the carrying capacity of the clamping of the concrete shell elements 1, 2.

FIG. 1*b* shows the same concrete shell elements 1, 2, which are now connected using three turnbuckle devices 12, 13, 14 according to the present invention.

The turnbuckle devices 12, 13, 14 each have a left first claw 15*a*, 15*b*, 15*c* and a right second claw 16*a*, 16*b*, 16*c*. The claws 15*a*, 15*b*, 15*c*, 16*a*, 16*b*, 16*c* may be displaced in the horizontal direction toward one another in the figure (=clamping direction), in order to press the concrete shell elements 1, 2 against one another. The clamping of the claws 15*a*, 15*b*, 15*c*, 16*a*, 16*b*, 16*c* may be set in each case by a wedge 17*a*, 17*b*, 17*c*. The wedges 17*a*, 17*b*, 17*c* have a wedge guiding direction (i.e., a translational direction into the particular turnbuckle device 12, 13, 14) diagonally downward. As a wedge 17*a*, 17*b*, 17*c* is advanced diagonally downward, the associated claws 15*a*, 15*b*, 15*c*, 16*a*, 16*b*, 16*c* are pulled together in the horizontal direction. The clamping direction, which is horizontal here, and the wedge guiding direction thus enclose an angle $\alpha$ less than 90°, specifically approximately 70° (See FIG. 2). The sign of the clamping direction and the wedge guiding direction are not considered in determining the angle $\alpha$, and only the smaller of the enclosed angles at an intersection of the two direction lines determined by the direction vectors is considered as the angle $\alpha$.

All three wedges 17*a*, 17*b*, 17*c* may be moved in accordance with their wedge guiding direction without obstructions occurring due to the turnbuckle devices 12, 13, 14 neighboring the wedges 17*a*, 17*b*, 17*c*. The full interval A between the turnbuckle devices 12, 13, 14 is available as movement space; with greater wedge inclination or more compact first claws 15*a*, 15*b*, 15*c*, it would even be more. There is also sufficient space above and below the wedges 17*a*, 17*b*, 17*c* to be able to act with comfort on a wedge end using standard tools, such as a hammer.

FIG. 2 shows an embodiment of a turnbuckle device 20 according to the present invention similar to the turnbuckle devices of FIG. 1*b* in a vertical cross-section.

The turnbuckle device 20 comprises a left first claw 21, a right second claw 22, and a wedge 23. The two claws 21, 22 guide one another mutually in order to allow relative movement of the claws 21, 22 in the horizontal direction, specifically the clamping direction 34. The wedge 23 is guided in the second claw 22 in a wedge guiding direction 33 using two openings 24, 25. The claws 21, 22 have legs 26, 27, 28, 29 which may rest on struts of concrete shell elements and enclose or engage in frame sections of concrete shell elements.

The first claw 21 has a profiled section 30 which is implemented having a row of teeth 31. The teeth 31 are slanted by an angle $\epsilon$ toward the clamping direction 34. The wedge 23 has multiple grooves 32, which are also slanted by an angle $\epsilon$ toward the clamping direction 34. The inclination of the teeth 31 is thus tailored to the grooved profile of the wedge 23 (i.e., the relative inclination of the grooves 32 to an propulsion direction 33 of the wedge 23) and the inclination of the wedge 23 in the turnbuckle device 20 (i.e., the angle $\alpha$). Furthermore, the interval of the grooves 32 is tailored to the interval of the teeth 31.

As the wedge 23 is advanced downward to the right, the edges of the grooves 32 are shifted parallel to the right at the height of the teeth 31, through which the teeth 31 are also shifted to the right. If the teeth 31 belong to the first claw 21, but the wedge 23 is guided in the second claw 22, there is a relative motion of the claws 21, 22 toward one another.

FIGS. 3*a* through 3*e* explain the geometric relationships on turnbuckle devices. The turnbuckle devices are each shown strongly schematically in that a projection of the particular wedge on a vertical plane is especially emphasized, while the claws are only illustrated as a dashed rectangle. The long sides of the dashed rectangle run parallel to the clamping direction, the short sides run parallel to the direction of the boundary line of concrete shell elements to be spanned.

FIG. 3*a* shows the limiting case of a possible arrangement of turnbuckle devices 30*a*, 30*b*, 30*c* having wedges 31*a*, 31*b*, 31*c* according to the related art in a clamped position. The wedges 31*a*, 31*b*, 31*c* all extend on a straight line, specifically the vertical connecting straight line of the center points 32*a*, 32*b*, 32*c* of the turnbuckle devices 30*a*, 30*b*, 30*c*. The term center point predominantly relates in this case to the center of the claw area and the center of the wedges in the clamped position shown. The positioning of the related art in this case has the problem that the wedges 31*a*, 31*b*, 31*c* mutually block their movement along their wedge guiding direction, which is coincident with the direction of the longitudinal extension of the wedges 31*a*, 31*b*, 31*c*. This is because the ends of the wedges 31*a*, 31*b*, 31*c* are in contact in the mounted state (or have a negligible distance in comparison to the length of the wedge). Such an arrangement may be used in principle for clamping concrete shell elements by maintaining the correct construction and disassembly sequence and/or by using special tools which do not require access to free ends of the wedges 31*a*, 31*b*, 31*c* for moving the wedges 31*a*, 31*b*, 31*c*, but this is complicated and may delay the positioning of concrete shell elements in relation to one another. This is also true for the disassembly of concrete shell elements clamped to one another.

In order to solve the problem of the wedges 31*a*, 31*b*, 31*c* and/or wedge ends, which stand in each others way, the teaching according to the present invention suggests that the wedges 31*a*, 31*b*, 31*c* and the associated wedge guiding directions be pivoted toward the clamping direction, the horizontal here. An exemplary possibility of pivoting from the perpendicular position of the wedges is shown in FIG. 3*a*. The wedges 31*a*, 31*b*, 31*c* are each pivoted slightly counterclockwise around their center points 32*a*, 32*b*, 32*c* as shown by the arrows 34.

FIG. 3*b* shows the arrangement after the pivoting around the minimum advisable pivot angle. This pivoting is connected, of course, to a novel construction of the turnbuckle devices, which are now identified in FIG. 3*b* by 35*a*, 35*b*, 35*c*. They are still arrayed on a vertical connection straight line, which is defined by center points 36*a*, 36*b*, 36*c* of the turnbuckle devices 35*a*, 35*b*, 35*c*, but the movement directions of the wedges 37*a*, 37*b*, 37*c* now run parallel next one another. The space required by each wedge 37*a*, 37*b*, 37*c* for movements in the wedge guiding direction overlaps neither with the required movements of another wedge 37*a*, 37*b*, 37*c*, nor with the location of another wedge 37*a*, 37*b*, 37*c*. In the clamped state of the arrangement shown in FIG. 3*b*, the wedges 37*a*, 37*b*, 37*c* have punctual contact to one another at their lower left and upper right corners, and may barely slide past one another during movements in the wedge guiding direction. However, the positions of the claws 38*a*, 38*b*, 38*c* delimit the movements of the wedges 37*a*, 37*b*, 37*c*.

FIG. 3*c* shows a detail from FIG. 3*b* to illustrate the determination of a suitable pivot angle β for obtaining the arrangement of FIG. 3*b*.

The wedge 37*b* contacts the neighboring wedge 37*c* at corner point E. The right edge of the wedge 37*b* lies in the extension of the left edge of the wedge 37*c*, so that the wedge 37*b* would just slide past wedge 37*c* without resistance in the event of a displacement upward to the left in the wedge guiding direction. The wedges 37*a*, 37*b*, 37*c* all have a width B and a length E.

A central axis 40 of the wedge 37*b* running in the wedge guiding direction (and the central axes of the other wedges 37*a*, 37*c*) must be pivoted by an angle β toward a vertical connecting straight line 41 of the center points of the wedges 37*a*, 37*b*, 37*c*. The central axis 40 runs through the center point M of the wedge 37*b* and the head point K, which is in the middle of the upper short side of the wedge 37*b*. The ratio of path length KE to path length KM defines the tangent of β. Therefore, β=arctan(path KE/path KM)=arctan(B/2/L/2)=arctan(B/L).

The angle β represents the completion angle of the angle α to 90°, because α runs as an angle between clamping direction (the horizontal 42 here) and the wedge guiding direction (represented by the central axis 40 here). Therefore, α=90°−arctan(B/L).

The arrangement of FIGS. 3*b* and 3*c* assumes that the wedges are not to overlap along their length in the mounted state, not even next to one another. This does avoid hazard points, wear, and problems with manufacturing tolerances of the turnbuckle devices according to the present invention, but is not an absolute requirement for the invention described.

Overlapping wedges of adjoining turnbuckle devices are illustrated in FIG. 3*d*. The turnbuckle devices 44*a*, 44*b*, 44*c* according to the present invention have the same width and the same mounting interval of their center points 45*a*, 45*b*, 45*c* and the same inclination of the wedges 46*a*, 46*b*, 46*c* as the arrangement of FIG. 3*b*. Only the length of the wedges 46*a*, 46*b*, 46*c* is greater than in the arrangement of FIG. 3*b*. Nonetheless, the wedges 46*a*, 46*b*, 46*c* have space for arbitrary movements along their wedge guiding direction, which is particularly not restricted by the neighboring wedges 46*a*, 46*b*, 46*c*. In this case, the wedges 46*a*, 46*b*, 46*c* barely slide off the neighboring wedges in the limiting case shown, which represents the largest advisable angle α according to the present invention between clamping direction and wedge guiding direction.

Actually, the space for movements of the wedges is a function of the width of the wedges 46*a*, 46*b*, 46*c*, the mounting interval of the turnbuckle devices according to the present invention having the diagonally guided wedges 46*a*, 46*b*, 46*c* therein, and the angle α.

This relationship is illustrated in FIG. 3*e*. It shows a detail from FIG. 3*d* and is used for illustrating the largest possible advisable angle α according to the present invention and/or the smallest possible advisable pivot angle γ in the case of wedge lengths greater than the mounting interval of the turnbuckle devices.

The turnbuckle devices 44*b*, 44*c* are arrayed on a connecting straight line 47 which is defined by the center points 45*b* and 45*c* of the wedges 46*b*, 46*c* in the clamping position or also as the center points 45*b* and 45*c* of the associated claw areas. The connecting straight line 47 intersects a boundary surface between the wedges 46*b* and 46*c* at the intersection S. The intersection S is at half the length of the connecting line of the center points 45*b* and 45*c*. The interval of the center points 45*b* and 45*c* (and therefore the interval of the turnbuckle devices 44*b*, 44*c* in the direction perpendicular to the clamping direction and/or in the direction parallel to the boundary line of the concrete shell elements to be connected) is A. The width of the wedges 46*b*, 46*c* measured perpendicularly to the wedge guiding direction is B. The wedge 46*b* has a central axis 48 which runs along the wedge guiding direction at half the width of the wedge 46*b*. An auxiliary line 49 runs perpendicularly to the central axis 48 and intersects the intersection S. The intersection of the auxiliary line 49 with the central axis 48 is identified as the internal point I of the wedge 46*b*.

The triangle MIS is observed to determine the pivot angle γ between the central axis 48 and the connecting straight line 47. M corresponds to 45*b*. The ratio of the lengths of the paths IS to SM defines the sine of γ. Therefore:

γ=arcsin(path IS/path SM)=arcsin(B/2/A/2)=arcsin(B/A).

The angle is the completion angle of the angle α to 90°, so that α=90°−arcsin(B/A).

It may be seen that in the frequently occurring case of small widths B compared to the interval A, the following applies as an approximation:

path length IM=path length SM. Observing this boundary condition, the sine may be approximated by the tangent.

In the case of conical wedges, the advantages of the present invention may be achieved in any case if the largest occurring width on the wedge is used as the width of the wedge as defined in the above observations. In specific cases, however, an averaged width may also be used.

Turnbuckle devices positioned arrayed along a straight line are used for clamping concrete shell elements, these turnbuckle devices having wedges for setting the clamping using the wedge propulsion. The wedges according to the present invention are positioned inclined toward this straight line in order to avoid collisions of wedges of neighboring turnbuckle devices as the wedges are advanced or driven out. Blocking of the access to the wedge ends by neighboring wedges is also prevented.

The invention claimed is:

1. A concrete shell system comprising:

concrete shell elements;

at least one device for clamping the concrete shell elements to one another, the device having spaced apart opposing claws displaceable toward one another in a clamping direction, the claws being configured for guiding one another for enabling the displacement toward and into one another in the clamping direction;

teeth disposed on one of the claws, said teeth being slanted at an angle with respect to the clamping direction;

a slidable wedge disposed through claw openings for causing displacement of the claws upon translational sliding movement of the wedge within the openings in a wedge guiding direction, said wedge guiding direction being inclined at an angle between 40° and 85° with respect to said clamping direction; and spaced apart parallel linear grooves disposed in said wedge for engaging said teeth for causing the displacement of the claws upon the translational sliding movement of the wedge within the claw openings.

2. The concrete shell system according to claim 1 wherein the angle is approximately 45°.

3. The concrete shell system according to claim 1 wherein the openings of each device are disposed on one of the claws of the device.

4. The concrete shell system according to claim 1 wherein the wedge has a constant size along the wedge guiding direction.

5. The concrete shell system according to claim 1 further comprising a plurality of the devices.

6. The concrete shell system according to claim 5 further comprising multiple mounting positions, each mounting position receiving one of the devices, the mounting positions being spaced apart from one another and aligned on a straight line perpendicular to the clamping direction, with the wedges inclined with respect to the straight line in order to enabling access to the wedges for movement of the wedges.

7. A concrete shell system comprising:

concrete shell elements each element having multiple spaced apart device mounting positions disposed along a straight line;

devices for clamping the concrete shell elements, one device being received at each mounting position, the devices each having two claws and a wedge, the claws of each device being displaceable toward and into one another in a clamping direction, each wedge being slidably guided in each clamping device along a wedge guiding direction with a sliding position of each wedge in the each device determining displacement of the claws of each device, the wedge of each device being positioned with a central axis running along the wedge guiding direction inclined with respect to the straight line and at an angle between 40° and 85° with respect to the clamping direction in order to avoid collisions of neighboring devices as each wedge is translationally advanced or driven out, each wedge having spaced apart parallel linear grooves for engaging teeth in on of the claws of each device.

* * * * *